United States Patent [19]

Sanvito et al.

[11] Patent Number: 4,901,658

[45] Date of Patent: Feb. 20, 1990

[54] ANGLED SUPPORT SURFACE FOR A MULTI SEWING MACHINE WORKING SITE

[75] Inventors: Roberto Sanvito; Adelio Ronchi, both of Milan, Italy

[73] Assignee: Rockwell-Rimoldi S.p.A., Olcella, Italy

[21] Appl. No.: 238,320

[22] Filed: Aug. 30, 1988

[30] Foreign Application Priority Data

May 30, 1988 [IT] Italy ..... 20795 A/88

[51] Int. Cl.[4] ..... D05B 21/00

[52] U.S. Cl. ..... 112/217.2; 112/155; 108/64

[58] Field of Search ..... 112/217.2, 217.1, 217.3, 112/217.4, 258, 260, 25, 155, 121.14, 121.15, 121.26, 121.12; 108/64, 59

[56] References Cited

U.S. PATENT DOCUMENTS

| | | | |
|---|---|---|---|
| 1,207,796 | 12/1916 | Roberts et al. | 112/217.2 |
| 2,374,529 | 4/1945 | Everitt | 112/155 |
| 3,053,598 | 9/1962 | Cheslow | 108/64 |
| 3,741,852 | 6/1973 | Keener | 108/64 X |
| 4,116,146 | 9/1978 | Matthews | 112/217.2 |

*Primary Examiner*—Andrew M. Falik

*Attorney, Agent, or Firm*—Laff, Whitesel, Conte & Saret

[57] ABSTRACT

A working site to stitch manufactured items comprises a supporting frame on which a supporting surface table (2) is defined, which surface is provided with a central area (4) having a first sewing machine (5) disposed thereon which can be used to perform the greatest number of sewing operations on a manufactured item which has to be submitted to a predetermined work cycle. Extending consecutively to the central area is a first side area (6) carrying a second sewing machine (7) adapted to be used to perform operations in intercalated relationship with the sewing operations carried out by the first sewing machine (5). A second side area (8) extending at right angles to the central area (4) on the opposite side with respect to the first side area (6) carries a third sewing machine (9) adapted to be used for trimming operations on the manufactured item as well as further operations in intercalated relationship with the operations to be performed by the first (5) and second (7) sewing machines. The three areas (4), (6), (8) of the supporting surface extend around the user in accordance with ergonomics studies to allow a manufactured item to be easily moved from a sewing machine to another.

4 Claims, 2 Drawing Sheets

ANGLED SUPPORT SURFACE FOR A MULTI SEWING MACHINE WORKING SITE

BACKGROUND OF THE INVENTION

1. Field of the Invention

The present invention relates to a working site to stitch manufactured items, of the type comprising a supporting frame defining at the top a supporting surface on which at least a sewing machine is disposed which is arranged to perform a given number of operations on a manufactured item being worked (or workpiece) and the front portion of which faces a user who is sitting in front of the supporting surface.

2. Prior Art

It is known that when the sewing of manufactured items such as garments and the like is concerned, many stitching operations of different types are requested. For example, on making a singlet or a vest it is necessary first of all to assemble and sew the different component parts thereof, then neck-bands or support tapes have to be applied to the neck edges and sometimes the sleeve edges; furthermore, when tapes are not intended to be applied, it is necessary to carry out hemmings at the lower ends of the singlet and the singlet sleeves.

In order to perform all operations necessary to manufacture a given item, the arrangement of a work chain formed of several consecutively aligned sites is provided in which each site is entrusted to a respective seamstress and substantially comprises a sewing machine adapted to execute a given working, which is mounted near a supporting table defined at the top of a supporting frame.

The number of sewing operations provided in a working cycle to obtain a finished item are brought to an end by a series of successive passages of the manufactured item from a work site to another. In greater detail, after the manufactured item has been submitted to a given working operation in a work site, it is delivered to the seamstress of the subsequent work site to be submitted to a new operation as provided by the working cycle.

However this working method has many drawbacks.

First of all, since the workpiece has to be transferred many times from a work site to another, there is an undesired increase in the handling time of the workpiece which adversely affects the productivity.

Many problems also arise from the fact that the work of each seamstress is, on one hand, subordinated to the productivity of all the other seamstresses which act upstream of said one seamstress—reference being made to the designed sequence for a working cycle—and, on the other hand, it exerts influence upon the work of the seamstresses acting downstream.

The above situation involves many difficulties in trying to reach the so-called "line-balancing", that is to ensure the graduate delivery to each seamstress of an amount of workpieces equal to the workpieces she is capable of sewing. In addition, not only said line-balancing is hardly achieved, but it can be easily impaired due to unexpected events such as for example the absence of a seamstress, the sewing machine breakdown and so on.

Furthermore each seamstress should also have a stock or supply of manufactured items to work at her disposal in order to prevent her from being devoid of said items when for any reason the seamstress coming before her temporarily stops or slackens production.

Taking into account the number of working sites usually provided, the stocks reach a rather important amount and consequently involve an increase in the dwell time of each workpiece in the production line. In fact, it is always necessary to add the time during which a workpiece stays as a stock at each working site, to the time materially used to carry out the appropriate stitching operations on a workpiece.

For all the above reasons a quick delivery of the ordered items is adversely affected. In fact it is impossible to start the working of a specific type of manufactured item if the supply of all manufactured items previously in course of working has not been exhausted. It will be recognized that this drawback involves serious difficulties when works of great urgency are ordered.

Furthermore it is to be pointed out that the presence of a plurality of working sites involves a long idle time every time it is necessary to make all sewing machines ready to sew a new type of manufactured item, when the preceding working is over. This is a particularly troublesome inconvenience when small amounts of manufactured items of different types must be sewn.

The known art also suffers the disadvantage that it is very difficult to immediately detect possible manufacture defects on the individual items being worked. On the contrary it often happens that a manufacture defect due for example to a wrong setting of the sewing machine, the inexperience of a seamstress or the like, is detected in one of the sites following that in which said defect has been caused. In this case the detected defect is likely to be present in all garments of the stocks existing in all sites comprised between the one in which the defect has originated and the one in which it was detected.

It is also to be noted that the above described production systems do not stimulate the interest of the staff designed for said working as their task is almost limited to the systematic and repeated execution of a reduced number of operations. This aspect as well as being obviously important from a human point of view, also has repercussions on the productivity and quality of the finished product.

SUMMARY OF THE INVENTION

The object of the present invention is to eliminate the problems of the known art as much as possible by providing a working in which a single seamstress can start and bring to an end a given working cycle comprising a plurality of different operations.

The foregoing and still further objects which will become more apparent in the course of the present description are substantially attained by a working site to stitch manufactured items, wherein said supporting surface has a central area on which a first sewing machine is mounted which can be used to carry out the greatest number of sewing operations on a manufactured item which has to be submitted to a predetermined work cycle, a first side area extending obliquely and consecutively to the central area, sideways with respect to the user, and carrying a second sewing machine to be used to perform sewing operations in intercalated relationship with the operations carried out by the first sewing machine, and a second side area extending consecutively to the central area at right angles thereto and still sideways to the user but facing the first side area, and carrying a third sewing machine to be used to perform trimming operations on the manufactured item as well as further operations in intercalated relationship with the operations to be performed by the first and second sewing machines.

BRIEF DESCRIPTION OF THE DRAWINGS

Further features and advantages will best be understood from the detailed description of a possible embodiment of a working site to stitch manufactured items in accordance with the present invention, given hereinafter by way of non-limiting example with reference to the accompanying drawings, in which.

DESCRIPTION OF THE PREFERRED EMBODIMENT

Figure 1:
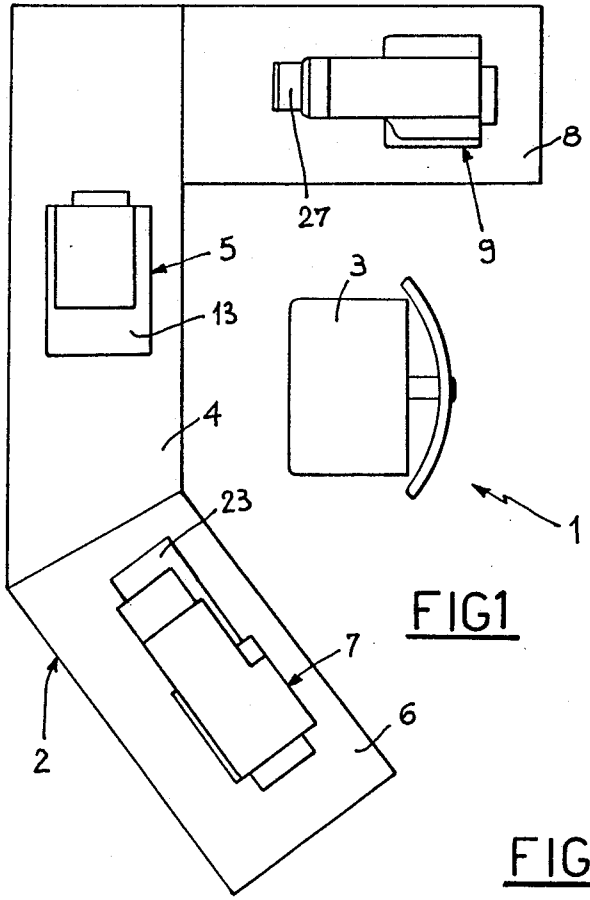
FIG. 1 is a schematic top view of a working site in accordance with the present invention.

With reference to the drawings, and particularly to FIG. 1, a working site to stitch manufactured items in accordance with the present invention has been globally identified by reference numeral 1.

The working site 1 comprises a supporting frame, (not shown as it can be accomplished in a plurality of known manners), defining at the top a supporting surface 2 in front of which is located a rotating chair 3 in which a user will be sitting.

In an original manner, the supporting surface 2 is divided into three areas, each of them carrying a sewing machine adapted to perform a given number of sewing operations.

In greater detail, there are: a central area 4 disposed in front of the user and carrying a first sewing machine 5, a first side area 6 extending consecutively and obliquely to the central area 4, sideways with respect to the user, and carrying a second sewing machine 7, and a second side area 8 extending at right angles to the central area 2 consecutively to the opposite side thereof and therefore facing the first side area 6, which second side area carries a third sewing machine 9.

The supporting surface 2 as a whole extends around the chair 3 so that the user can individually utilize the sewing machines 5, 7 and 9 by merely carrying out angular rotations to move the workpiece from a sewing machine to another.

Therefore the sewing machines 5, 7 and 9, which are selected on the basis of the working to be performed therewith, lend themselves to be individually used according to a predetermined sequence, in order to start and bring to an end a specific work cycle on a manufactured item being worked.

As a general rule, in accordance with the present invention the central area 4 is designed to carry the sewing machine which will be used the most for the accomplishment of the work cycle, whereas the second side area will carry the machine to be used the least.

In order words, of the three sewing machines the first one 5 will be set so that it may carry out the greatest number of sewing operations provided in a work cycle. The second sewing machine 7 will in turn be set for carrying out sewing operations in intercalated relationship with the operations performed by the first sewing machine 5. On the contrary the third sewing machine 9 will be able to perform trimming operations if necessary, and further possible operations in intercalated relationship with those carried out by the second 7 and first 5 sewing machines.

Figure 2:
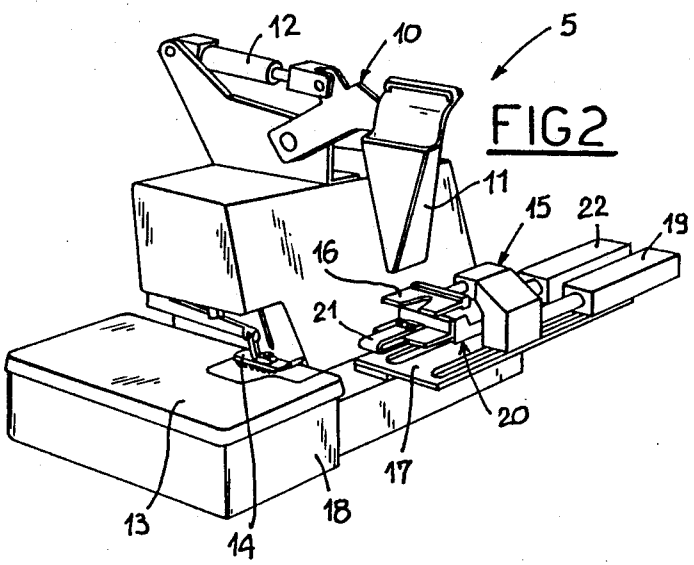
FIG. 2 is a perspective view showing, by way of non-limiting example, a first sewing machine located on a central area of the supporting surface being part of the site shown in FIG. 1.
Figure 5B:
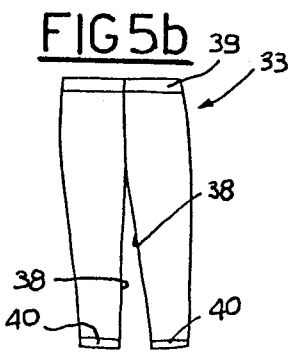
FIG. 5*b* schematically shows a pair of pajamas trousers which can be produced by the working site referred to in the preceding figures and adapted to be associated with the singlet shown in FIG. 5*a* to form a complete suit.
Figure 5A:
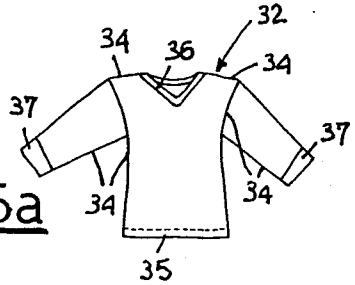
FIG. 5*a* schematically shows a pajamas singlet which can be produced by the working site referred to in the preceding figures.
Figure 4:
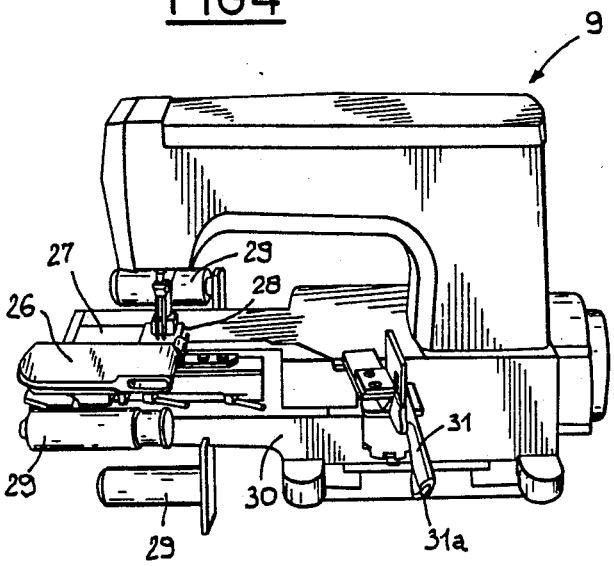
FIG. 4 is a schematic front view, still by way of non-limiting example, of a third sewing machine which can be installed on a second side area of the supporting surface.
Figure 3:
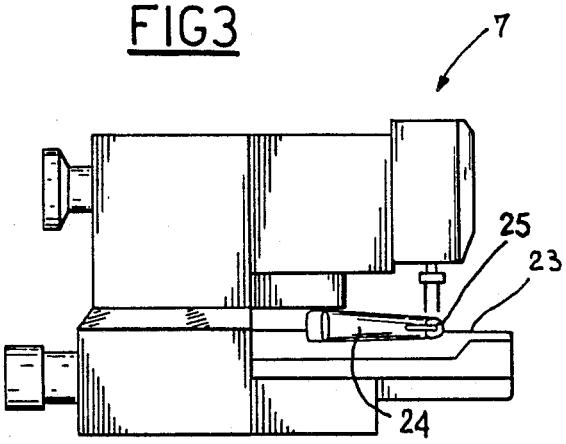
FIG. 3 is a perspective view of a second sewing machine which can be associated with a first side area of said supporting surface.

FIGS. 2, 3 and 4 show a first, second and third machine respectively, given by way of example only, associated with the work site 1 when the latter is arranged to stitch manufactured items in order to produce pajamas of the type shown in FIGS. 5*a* and 5*b*.

As shown in FIG. 2, the first sewing machine 5 is of a type adapted to execute an overedge stitch on either side of the edges of the workpiece and is provided, in known manner, with additional devices adapted to carry out, as well as normal stitchings, hemming operations and the sewing of different types of neck-bands, tapes and other ribbon-like trimmings along the edges of the manufactured item. Said sewing machine has already been the subject matter of U.S. patent application Ser. No. 07/220,540 filed July 18, 1988.

Since said sewing machine 5 is already known per se, it will not be described in detail. Briefly, it is reminded that the sewing machine 5 is provided with a feed unit 10 comprised of a feed guide 11 fastened at the top to the sewing machine and movable, upon command of a fluid-operated cylinder 12, from a rest position shown in FIG. 2 to a working position in which the guide substantially operates flush with the workpiece supporting table 13 of said sewing machine to feed a ribbon-like piece of trimmings under the presser foot 14 while a stitching is being carried out.

Consequently the piece of ribbon-like trimmings will be engaged by said stitching and in this manner sewn along a corresponding edge of the manufactured item, to be automatically cut, at the end of sewing, by a cutting unit 15.

The cutting unit 15 substantially comprises a cutting member 16 mounted on a guide 17 secured to the sewing machine bed 18 and movable, upon command of a fluid-operated actuator 19, from a rest position shown in FIG. 2 to a working position in which it acts in front of the presser foot 14 to cut the piece of trimmings in the portion between the presser foot and the feed guide 11.

The first sewing machine 5 is also provided with a hemming group 20 comprised of a hem folder 21 slidably connected to the guide 17 and movable, upon command of a further fluid-operated cylinder 22, from a rest position shown in FIG. 2 to a working position in which it acts flush with the supporting table 13 and in front of the presser foot 14 to guide and suitably shape the edge of the manufactured item being worked.

If necessary, the hem folder 21 can be replaced by a puckering guide not shown as known and conventional, or other members of different types, depending upon the requirements.

We refer now to FIG. 3. The second sewing machine 7 is a conventional flat bed sewing machine of the left type, provided with two needles. It is to be noted that the workpiece supporting table 23 of the second sewing machine 7 is disposed towards the workpiece supporting table 13 of the first sewing machine 5, as the latter is of the right type and the first side area 6 carrying the second sewing machine is situated on the side towards which the supporting table 13 of the first sewing machine is oriented, that is on the left of the central area 4. Thanks to this arrangement, the workpiece supporting tables 23 and 13 of the second 7 and first 5 sewing machines can be disposed remarkably near each other so that the user is facilitated in moving the workpiece from one of said machines to the other.

The second sewing machine 7 is provided with a respective feed guide 24 the free end of which 25 is disposed flush with the supporting table 23 and in front of the corresponding presser foot (not shown) to feed said presser foot with a ribbon-like piece of trimmings, such as a tape, of a different type with respect to the one to be sewn with the first sewing machine.

Referring to FIG. 4, the third sewing machine 9 is a cylindrical bed sewing machine of the right type, with two needles, provided with a hem folder 26 arranged to operate flush with the supporting table 27 and in front of the presser foot 28 to guide a folded edge of the workpiece under the presser foot.

In known manner, the hem folder 26 is also capable of slidably engaging an elastic band previously fitted on supporting rollers 29 distributed around the bed 30 of the third sewing machine 9 to cause the elastic band to be engaged within the fold formed along the workpiece edge and be therefore fixed in place during the stitching.

The third sewing machine is also provided with a respective feed guide 31 the free end of which 31*a* is designed to operate flush with the workpiece supporting table 27 and in front of the presser foot 28 to send a ribbon-like piece of trimmings under said presser foot, said trimmings being of different type and color as compared with the trimmings sewn using the previously described sewing machines.

The hem folder 26 and the feed guide 31 are driven by respective fluid-operated cylinders to be individually and selectively brought to their respective working positions in order to allow the hemming and, if necessary, the application of an elastic band, and the application of a tape astride of one edge of the manufactured product respectively.

The third sewing machine 9 has been the subject of U.S. patent application Ser. No. 07/238,742 filed May 30, 1988 U.S. Pat. No. 4,827,857. Therefore said machine is not described herein in detail as it has been made known by said application to which please refer for further information.

After the above description the accomplishment of pajamas consisting of a singlet identified by 32 in FIG. 5*a* and a pair of trousers identified by 33 in FIG. 5*b* takes place in the following manner.

Preferably an electronic control unit of a known and conventional type is associated with the working site 1; once a determined work cycle has been keyed in, said control unit is capable of automatically setting the sewing machines 5, 7, 9 so that they are ready to sequentially execute the necessary sewing operations without requiring any intervention on the part of the operator.

Referring particularly to FIG. 5*a*, if we have to start the execution of a singlet 32, first of all, using the first sewing machine 5, it is necessary to make all lines of stitching identified by 34 which are adapted to obtain the assembling of the main components of the singlet previously cut to size. These assembling operations are carried out sequentially sewing with overedge stitches the previously superposed edges of the fabric parts to be joined to each other. Therefore, during the execution of these operations the feed guide 11, hem folder 21 and cutting member 16 of the first sewing machine 5 are in a rest position, as shown in FIG. 2.

Then the execution of a hemming along the lower edge 35 of the singlet 32 may be needed. This operation too is performed by the first sewing machine 5 which is set with its hem folder 21 in a working position in front of the presser foot 14.

In place of the above hemming operation, it may also be provided that a tape should be applied to the lower edge 35 of said singlet. This application too can be executed using the first sewing machine 5 and in this case the feed guide 11 thereof should be arranged in a working position.

However the application of said tape to the lower edge 35 could also be executed using the second sewing machine 7 or the third sewing machine 9.

Then a neck-band 36 has to be sewn along the neck edges of singlet 32 and the second sewing machine 7 could be used to this end. In this case the user will be able to pass quickly from the use of the first machine 5 to the use of the second machine 7 through a reduced displacement of the workpiece. Obviously the neck-band 36 could be sewn using the third sewing machine 9 as well as with the aid of the feed guide 31 associated therewith.

The last operation to complete the singlet 32 is the application of tapes 37 along the lower edges of the sleeves. Depending upon the type of tape to be applied and/or the type of stitching to be used, said operation can be carried out using the first, second or third sewing machines, 5, 7 and 9 respectively. It may also be provided that hemming operations should be executed with the first machine 5, in place of the application of tapes.

Once the singlet 32 is finished, it is possible to proceed with the execution of stitchings on trousers 33.

In this case too the use of the first sewing machine 5 is first of all provided in order to execute the assembling seams 38 along the edges of the main trousers components. Afterwards, using the third machine 9 a hemming operation is performed along the upper edge 39 of the trousers with the simultaneous introduction of an elastic endless band thereinto.

For the execution of the above operation the hem folder 26 provided in the third sewing machine 9 is used.

Finally, tapes 40 can be applied to the lower end edges of the trousers legs. Said tapes too can be applied with the third sewing machine 9, with the aid of the feed guide 31, or using the first or second sewing machines, 5 or 7 respectively, depending upon the type of tape to be applied and/or the type of stitching to be used.

Along the lower ends of the trousers legs it is also possible to execute hemmings in place of the application of tapes 40 and in this case the first sewing machine 5 with the aid of the hem folder 21, or the third machine 9 with the aid of the hem folder 26 can be indifferently used.

The present invention attains the intended purposes.

In fact by virtue of the work site in question a single operator can begin and bring to an end a specific work cycle comprising a plurality of different sewing operations. Therefore the present invention solves most of the problems connected with the working methods of a traditional type which require that a manufactured item should pass from a work site to another each time a different sewing operation has to be performed.

It is also to be noted that the work site in question exhibits flexibility of use independently of the sewing operations it is designed for. The flexibility is due to the presence of three different sewing machines. This allows the operator to choose one of them for carrying out specific sewing operations depending upon the particular requirements at that time. In fact in this work site there are three sewing machines adapted to execute different types of stitchings and to apply three different types of ribbon-like trimmings. In addition two of said machines can carry out two different types of hemmings on the workpiece, one of the two types also providing the introduction of an elastic endless band.

Obviously many modifications and variations can be made to the invention as conceived, all falling within the scope of the inventive idea characterizing it. In particular, the arrangement of the sewing machines in the central area and in the side areas of the supporting surface 2 is not compulsory, as the location of said machines can be chosen depending upon the type of workings to be performed.

What is claimed is:

1. A working site for one user to stitch manufactured items comprising a supporting frame having a top with first, second and central supporting surfaces on which sewing machines are mounted and arranged to perform a given number of operations on a manufactured item being worked by said user who is sitting in front of the supporting surfaces, wherein:

said central surface has two ends, a first sewing machine mounted on said central surface between said two ends and which can be used to carry out the greatest number of sewing operations on a manufactured item which has to be submitted to a predetermined work cycle;

said first surface extending obliquely and consecutively from one end of the central surface and facing one side of the user, said first surface having a second sewing machine mounted thereon to be used to perform sewing operations in intercalated relationship with the operations carried out by the first sewing machine; and said second surface extending consecutively from the other end of the central surface substantially at a right angle and facing the other side of the user when the user is facing the central surface, said second surface carrying a third sewing machine to be used to perform trimming operations on the manufactured item as well as further operations in intercalated relationship with the operations to be performed by the first and second sewing machines.

2. The working site of claim 1 wherein said first and second sewing machines each have a workpiece supporting table adjacent said one end of the central area.

3. The working site of claim 2 wherein the first sewing machine is of the type adapted to execute an overedge stitch on either side of workpiece edges, hemming operations, and sewing neck-bands, tapes and ribbon-like trimmings along the edges of the workpiece;

said second sewing machine is a flat bed sewing machine of the lift type and provided with two needles; and said third sewing machine is a cylindrical bed sewing machine of the right type and provided with two needles.

4. The work site of claim 1 wherein said first, second and central surfaces are sized and angled to each other in a predetermined manner so that the first, second and third sewing machines are easily accessible to the user.

* * * * *